US005841047A

United States Patent [19]

Mandreck

[11] Patent Number: 5,841,047

[45] Date of Patent: Nov. 24, 1998

[54] METHOD OF VIOLIN CONSTRUCTION AND A VIOLIN

[76] Inventor: Collin Mandreck, 102, 3638 - 117 Avenue, Edmonton, Alberta, Canada, T5W 0X8

[21] Appl. No.: 699,340

[22] Filed: Aug. 19, 1996

[51] Int. Cl.[6] ..... G10D 1/02

[52] U.S. Cl. ..... 84/274; 89/275; 89/291

[58] Field of Search ..... 84/274, 275, 291, 84/309

[56] References Cited

U.S. PATENT DOCUMENTS 4,838,140 6/1989 Meissner ..... 84/275

*Primary Examiner*—Cassandra C. Spyrou
*Attorney, Agent, or Firm*—Davis and Bujold

[57] ABSTRACT

A violin characterized by a violin body proportioned so that a sum of digits for each measurement which one skilled in the art of violin construction would recognize to be critical, when measured in millimeters, equals nine.

20 Claims, 1 Drawing Sheet

| | |
|---|---|
| AB | WIDEST TOP LINE |
| BC | TOP CORNERS |
| CD | MIDPOINT (CENTRE) OF VIOLIN |
| DE | BOTTOM OF SOUND HOLES |
| EF | WIDEST PART OF VIOLIN |
| FG | WIDEST BOTTOM LINE |

METHOD OF VIOLIN CONSTRUCTION AND A VIOLIN

FIELD OF THE INVENTION

The present invention relates to a method of violin construction and a violin constructed in accordance with the teachings of the Method.

BACKGROUND OF THE INVENTION

The study of the art of violin making is set forth in the book "A Review of Ancient and Modern Violin Making" by W. W. Oaks, which was first published in 1899. In this publication Oaks shared his insights with respect to the proper proportioning or graduation of violins by the old masters such as Stradivarius. Those insights were expressed as follows:

"It has been my privilege to gather the most minute details of a number of old instruments, and I found them anything but satisfactory. In examining two of the same model, and of equal merit, I found that the interiors were plain contradictions. I have never found two of the same maker alike. I could only infer that the intentions in both were the same, with, however, a very imperfect fulfilment of that intention. Most of the old models differed less in outward appearance than in inner construction. What could be more confusing to the student, when upon examining two violins of equal merit, to find the construction of the two diametrically opposed to the other, or to examine two of the same maker, only to find as great a difference."

In his work Oaks sets forth a system of graduation derived from a Stradivarius model of violent:

| | |
|---|---|
| "Total exterior length of body | 355 mm |
| Breadth across upper bouts | 165 mm |
| Breadth across lower bouts | 206 mm |
| Breadth across inner bouts | 109 mm |
| Length of inner bouts | 076 mm |
| Length from base of button to notch of F-holes | 193 mm |
| Height of sides, upper bouts | 030 mm |
| Height of sides, lower bouts | 031 mm |
| Length of neck | 130 mm |
| Length of finger board | 260 mm" |

The conclusion that Oaks reaches from his studies are summarized in the following quotations:

"I have spoken of a "perfect system of graduation". This is conditional. What would be perfect for one form of arching and quality of wood would be imperfect for another."

"It is rarely the case that I treat two violins alike, and never so unless I know the wood to be just the same, and I wish to make two violins of the same quality; then, of course, the work must be done in precisely the same manner."

In modern day violin construction the normal practise is to base the graduation of the instrument upon the works of the masters, such as Stradivarius and Amati. Placement of the f-holes tends to be determined by individual choice regarding the aesthetics of the body shape or the pattern copied from the masters.

SUMMARY OF THE INVENTION

What is required is a method of violin construction that involves a mathematically defined repeatable form of graduation.

According to one aspect of the present invention there is provided a method of violin construction. The method includes the step proportioning a body of a violin so that a sum of digits for each measurement which one skilled in the art of violin construction would recognize to be critical, when measured in millimetres, equals nine.

The present invention is based upon the principle that there must be some preferred mathematical relationship upon which graduation of an instrument may be based. It has been found that the number 9 has both quantitative and qualitative properties that result in exceptional tonal qualities and projection properties in a violin. Although a violin can be built in differing sizes, it is preferred that numerical relationship be maintained, without regard to size. Some of the measurements that one skilled in the art would recognize as being of importance include an external body length measurement, an internal length measurement of an acoustic chamber, internal breadth measurements taken along the acoustic chamber at intervals measured from immediately adjacent an internal top block, bridge positioning, and the location of sound holes relative to the top block, a center line and the bridge.

According to another aspect of the present invention there is provided a violin body proportioned so that a sum of digits for each measurement which one skilled in the art of violin construction would recognize to be critical, when measured in millimetres, equals nine.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
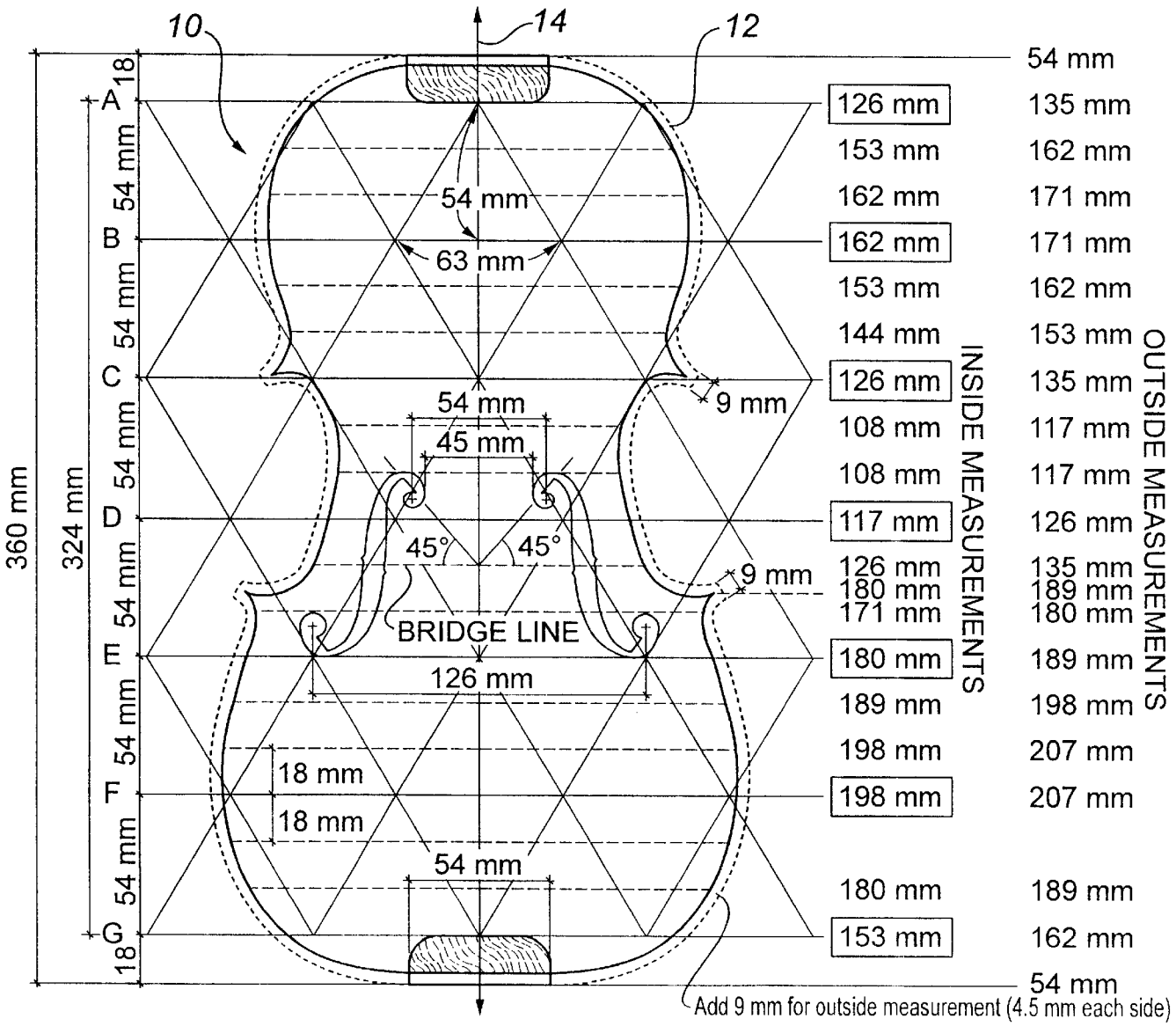
FIG. 1 is a top plan view, with a measurement grid superimposed thereon, of a violin constructed in accordance with the teachings of the present invention.

The preferred embodiment, a violin generally identified by reference numeral 10, will now be described with reference to FIG. 1.

Violin 10 is illustrative of one way in which the teachings of the present invention can be put into practise to produce a violin that has superior tonal qualities and projection properties. In accordance with the teachings of the present invention violin 10 has a violin body 12 defining a longitudinal axis 14 proportioned so that a sum of digits for each measurement which one skilled in the art of violin construction would recognize to be critical, when measured in millimetres, equals nine. For example, violin body 12 has an external length of 360 mm; 3+6+0=9.

The proportion or graduation of violin body 12 will now be further described. The violin body has an outer length of 360 mm. Top and bottom blocks are both 18 mm in width. The resultant internal length (measure from top to bottom block, Point A to Point G on FIG. 1.) is 324 mm. The internal length of the violin body is divided into six (6) equal areas comprised of 54 mm each. The inner and outer width measurements of the violin body are given on FIG. 1 by dividing each of the 54 mm long areas into 3 equal parts each 18 mm long. Outer width measurements are 9 mm greater than inner measurements allowing for 4.5 mm one each side. The table below restates the information regarding width to length relationships as shown in FIG. 1.

TABLE 1

Width Measurements Corresponding to Length.
(all measurements are millimeters (mm))

| Length Measurement | | Inner Width | Outer Width |
|---|---|---|---|
| Point A | 0 | 126 | 135 |
| | 18 | 153 | 162 |
| | 36 | 162 | 171 |
| Point B | 54 | 162 | 171 |
| | 72 | 153 | 162 |
| | 90 | 144 | 153 |
| Point C | 108 | 126 | 135 |
| | 126 | 108 | 117 |
| | 144 | 108 | 117 |
| Point D | 162 | 117 | 126 |
| Bridge Line | 180 | 126 | 135 |
| | 198 | 171 | 180 |
| Point E | 216 | 180 | 189 |
| | 234 | 189 | 198 |
| | 252 | 198 | 207 |
| Point F | 270 | 198 | 207 |
| | 288 | 189 | 198 |
| | 306 | 171 | 180 |
| Point G | 324 | 135 | 144 |

The violin body is 63 mm in depth. The rib, comprising the side panel, is 30 mm in width. The violin is a total of 99 mm in width when one considers the 63 mm body depth and the 36 mm tall bridge.

All of the following measurements, critical to the design of the violin described herewithin, are given relative to the top block (Point A). The design and measurements have been found to be critical in that the acoustical quality produced results from the proper placement of the sound holes and bridge in the middle compartment of the violin (see #3 below) relative to specific volume created by the above dimensions (Table 1).

1. Sound Hole Placement a) the centre of the lower sound hole is 207 mm from the top block (Point A) and located 63 mm from the centre line b) the lower curve of the sound hole touches a line running through Point E 216 mm from the top block c) the centre of the top sound hole is 153 mm from the top block (Point A) and 27 mm from the centre line d) the flattened portion of the upper sound hole lies on a line drawn at 45 degrees from the centre of the violin top, which is defined by the intersection of the center line with a bridge line (180 mm from the top block, Point A)

e) the inner edge of the top sound hole is 22.5 mm from the center line, thus the inner edges of the upper sound holes are 45 mm apart f) the centres of the top sound holes are 27 mm from the center line thus 54 mm apart g) the distance from the center of the top sound hole to the center of the bottom sound hole is 63 mm h) the notches in the center of the sound hole, which create the f-like appearance, must line equidistant above and below the bridge line (defined above)

This sound hole placement is necessary so as to prevent the acoustical vibrations passed from the bridge to the violin top being dampened by the sound holes. No part of the sound hole should line in the path of the feet of the bridge on lines running the length of the violin. Should the sound holes be placed in a manner contrary to this description and have any portion of their shape line in the path of lines running the length of the violin from the bridge feet, then the sound vibrations transmitted from the strings to the wood of the violin top by the bridge will be interfered with by the hole and effectively dampened destroying the acoustical quality of the instrument.

2. Bridge Placement

The bridge (36 mm in height) must be placed on the bridge line (180 mm from the top block). The feet of the bridge will then fall between two lines defined by the placement of the notches in the sound holes.

3. Three Sound Compartments

Another critical measurement on this violin places the lower edges of the upper corners which mark the beginning of the narrowing of the violin's centre compartment. These corners are located 108 mm from the top block on a line running through Point C.

As a result of these measurements three concurrent compartments are created, each 108 mm in length. The first compartment exists from the top block (Point A) to the lower edges of the corners (Point C). The second, containing the sound holes continues to the lower edge of the sound holes (Point E). The third continues from that point to the bottom block (Point G). The second compartment containing the properly positioned sound holes and bridge is believed to be the critical chamber of the violin.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. In a violin having a neck, a body and a bridge all being aligned with one another along a longitudinal axis of the violin, a top surface of said violin being provided with a pair of sound holes, and an interior compartment of said body having first and second opposed blocks;

wherein an exterior length of said body, when measured along said longitudinal axis in whole number millimeters, is a factor of 9;

a spacing between facing end surfaces of said first and second opposed blocks, when measured along said longitudinal axis in whole number millimeters, is a factor of 9;

a length of said blocks, when measured along said longitudinal axis in whole number millimeters, is a factor of 9; and a maximum transverse exterior depth of said violin, when measured from one exterior surface to the other along said longitudinal axis of said violin in whole number millimeters, is a factor of 9.

2. In a violin according to claim 1, wherein said interior compartment of said body is divided into a first compartment, a second compartment, and a third compartment, and each of said first, second and third compartments has a length, when measured along said longitudinal axis in whole number millimeters, which is a factor of 9;

a transverse interior width dimension at an interface between said first interior compartment and said second interior compartment, when measured in whole number millimeters, is a factor of 9; and a transverse interior width dimension at an interface between said second interior compartment and said third interior compartment, when measured in whole number millimeters, is a factor of 9.

3. In a violin according to claim 2, wherein each of said first interior compartment, said second interior compartment and said third interior compartment has a length dimension which is equal to one another;

a transverse interior width dimension of said violin at an interface between said first block and said first interior compartment, when measured in whole number millimeters, is a factor of 9; and a transverse interior width dimension of said violin at an interface between said third interior compartment and said second block, when measured in whole number millimeters, is a factor of 9.

4. In a violin according to claim 3, wherein said bridge is located along said longitudinal axis of said violin and a depth dimension of said violin, including said bridge, when measured at said longitudinal axis in whole number millimeters is a factor of 9;

a spacing of said bridge from said first block, when measured along said longitudinal axis in whole number millimeters, is a factor of 9;

a dimension of said bridge, extending perpendicular to said longitudinal axis, is less than a minimum spacing of said pair of sound holes from one another; and an end portion of each of said pair of sound holes is located coincident with a transverse plane defining the interface between said second interior compartment and said third interior compartment.

5. In a violin according to claim 1, wherein said pair of sound holes each have a length, when measured along said longitudinal axis of said violin in whole number millimeters, which is a factor of 9; and a minimum spacing of said pair of sound holes from one another, when measured transverse to said longitudinal axis of said violin in whole number millimeters, is a factor of 9.

6. In a violin according to claim 1, wherein a transverse exterior width dimension at an interface between said first interior compartment and said second interior compartment is a factor of 9, when measured in whole number millimeters; and a transverse exterior width dimension at an interface between said second interior compartment and said third interior compartment is a factor of 9, when measured in whole number millimeters.

7. In a violin according to claim 1, wherein said bridge is located along said longitudinal axis and extends perpendicularly to said longitudinal axis, said bridge is located between said sound holes and forms a bridge line, and said bridge line is spaced from said first block, when measured along said longitudinal axis in whole number millimeters, a distance which is a factor of 9; and said bridge has a height dimension which is a factor of 9, when measured in whole number millimeters.

8. In a violin according to claim 1, wherein a first compartment, a second compartment and a third compartment are formed along the length of said violin and each of said first, second and third compartments have an equal length dimension;

said second compartment is located adjacent said bridge and said sound holes; and said first compartment, said second compartment and said third compartment each have a length dimension which is a factor of 9, when measured in whole number millimeters.

9. In a violin according to claim 1, wherein said interior compartment, when measured transversely along said longitudinal axis at 18 millimeter interval starting from said first block, has:

an internal breadth of 126 millimeters at 0 millimeters from said first block;

an internal breadth of 153 millimeters at 18 millimeters from said first block;

an internal breadth of 162 millimeters at 36 millimeters from said first block;

an internal breadth of 162 millimeters at 54 millimeters from said first block;

an internal breadth of 153 millimeters at 72 millimeters from said first block;

an internal breadth of 144 millimeters at 90 millimeters from said first block;

an internal breadth of 126 millimeters at 108 millimeters from said first block;

an internal breadth of 108 millimeters at 126 millimeters from said first block;

an internal breadth of 108 millimeters at 144 millimeters from said first block;

an internal breadth of 117 millimeters at 162 millimeters from said first block;

an internal breadth of 126 millimeters at 180 millimeters from said first block;

an internal breadth of 171 millimeters at 198 millimeters from said first block;

an internal breadth of 180 millimeters at 216 millimeters from said first block;

an internal breadth of 189 millimeters at 234 millimeters from said first block;

an internal breadth of 198 millimeters at 252 millimeters from said first block;

an internal breadth of 198 millimeters at 270 millimeters from said first block;

an internal breadth of 189 millimeters at 288 millimeters from said first block;

an internal breadth of 180 millimeters at 306 millimeters from said first block; and an internal breadth of 153 millimeters at 324 millimeters from said first block.

10. In a violin according to claim 1, wherein a distance between adjacent ends of said sound holes to said first block, when measured along said longitudinal axis in whole number millimeters, is a factor of 9; and a distance between opposed adjacent ends of said sound holes to said second block, when measured along said longitudinal axis in whole number millimeters, is a factor of 9.

11. A method of manufacturing a violin having a neck, a body and a bridge all being aligned with one another along a longitudinal axis of the violin, a top surface of said violin being provided with a pair of sound holes, and an interior compartment of said body having first and second opposed blocks; said method comprising the steps of:

forming an exterior length of said body, when measured along said longitudinal axis in whole number millimeters, to be a factor of 9;

spacing facing end surfaces of said first and said opposed second blocks from one another by a distance, when measured along said longitudinal axis in whole number millimeters, which is a factor of 9;

forming said blocks of a length, when measured along said longitudinal axis in whole number millimeters, which is a factor of 9; and forming a maximum transverse exterior depth of said violin, when measured from one exterior surface to the other along said longitudinal axis of said violin in whole number millimeters, to be a factor of 9.

12. The method according to claim 11, further comprising the step of dividing said interior compartment of said body into a first compartment, a second compartment, and a third compartment, and each of said first, second and third compartments having a length, when measured in whole number millimeters along said longitudinal axis, which is a factor of 9;

forming a transverse interior width dimension at an interface between said first interior compartment and said second interior compartment, when measured in whole number millimeters, to be a factor of 9; and forming a transverse interior width dimension at an interface between said second interior compartment and said third interior compartment, when measured in whole number millimeters, to be a factor of 9.

13. The method according to claim 12, further comprising the step of forming each of said first interior compartment, said second interior compartment and said third interior compartment with a length dimension, when measured in whole number millimeters, which is equal to one another;

forming a transverse interior width dimension of said violin at an interface between said first block and said first interior compartment to be a factor of 9, when measured in whole number millimeters; and forming a transverse interior width dimension of said violin at an interface between said second block and said third interior compartment to be a factor of 9, when measured in whole number millimeters.

14. The method according to claim 13, further comprising the step of locating said bridge along said longitudinal axis of said violin;

forming an exterior depth dimension of said violin, including said bridge, when measured along but transverse to said longitudinal axis in whole number millimeters, to be a factor of 9;

spacing said bridge from said first block a distance which is, when measured along said longitudinal axis in whole number millimeters, a factor of 9;

forming said bridge to have a transverse dimension which is less than a minimum transverse spacing between said pair of sound holes provided in the top surface of said violin; and locating an end portion of each of said pair of sound holes coincident with a plane defining the interface between said second interior compartment and said third interior compartment.

15. The method according to claim 11, further comprising the step of forming said pair of sound holes of a length, when measured along a longitudinal axis of said violin in whole number millimeters, which is a factor of 9; and spacing said pair of sound holes from one another by a minimum distance, when measured transverse to said longitudinal axis of said violin and in whole number millimeters, which is a factor of 9.

16. The method according to claim 11, further comprising the step of forming an exterior width of said violin, at an interface between said first interior compartment and said second interior compartment, which is a factor of 9, when measured in whole number millimeters; and forming an exterior width of said violin, at an interface between said second interior compartment and said third interior compartment, which is a factor of 9, when measured in whole number millimeters.

17. The method according to claim 11, further comprising the step of placing said bridge along said longitudinal axis, but extending perpendicular thereto, between said pair of sound holes to define a bridge line, and spacing said bridge line from said first block by a distance which is a factor of 9, when measured in whole number millimeters; and forming said bridge to have a height which is a factor of 9, when measured in whole number millimeters.

18. The method according to claim 11, further comprising the step of forming a first compartment, a second compartment and a third compartment such that each of said first, second, and third compartments having an equal length dimension, when measured along said longitudinal axis of said violin;

locating said bridge and said sound holes adjacent said second compartment;

forming said first compartment, said second compartment and said third compartment of a length dimension which is a factor of 9, when measured in whole number millimeters.

19. The method according to claim 11, further comprising the step of forming said interior compartment, when measured transversely along said longitudinal axis at 18 millimeter interval starting from said first block, to have:

an internal breadth of 126 millimeters at 0 millimeters from said first block;

an internal breadth of 153 millimeters at 18 millimeters from said first block;

an internal breadth of 162 millimeters at 36 millimeters from said first block;

an internal breadth of 162 millimeters at 54 millimeters from said first block;

an internal breadth of 153 millimeters at 72 millimeters from said first block;

an internal breadth of 144 millimeters at 90 millimeters from said first block;

an internal breadth of 126 millimeters at 108 millimeters from said first block;

an internal breadth of 108 millimeters at 126 millimeters from said first block;

an internal breadth of 108 millimeters at 144 millimeters from said first block;

an internal breadth of 117 millimeters at 162 millimeters from said first block;

an internal breadth of 126 millimeters at 180 millimeters from said first block;

an internal breadth of 171 millimeters at 198 millimeters from said first block;

an internal breadth of 180 millimeters at 216 millimeters from said first block;

an internal breadth of 189 millimeters at 234 millimeters from said first block;

an internal breadth of 198 millimeters at 252 millimeters from said first block;

an internal breadth of 198 millimeters at 270 millimeters from said first block;

an internal breadth of 189 millimeters at 288 millimeters from said first block;

an internal breadth of 180 millimeters at 306 millimeters from said first block; and an internal breadth of 153 millimeters at 324 millimeters from said first block.

20. The method according to claim 11, further comprising the step of spacing a first end portion of said sound holes from said first block, when measured along said longitudinal axis and in whole number millimeters, to be a distance which is a factor of 9; and spacing an opposed second end portion of said sound holes from said second block, when measured along said longitudinal axis and in whole number millimeters, to be a distance which is a factor of 9.

* * * * *